United States Patent [19]

Leach et al.

[11] Patent Number: 4,920,724

[45] Date of Patent: May 1, 1990

[54] SPACER FOR CONCRETE REINFORCING FABRIC

[76] Inventors: Christopher B. Leach, 11576 Blue Water Hwy., Lowell, Mich. 49331; John L. Kaines, 303 N. Gaylord, Ludington, Mich. 49431

[21] Appl. No.: 173,107

[22] Filed: Mar. 28, 1988

[51] Int. Cl.[5] ..... E04C 5/16

[52] U.S. Cl. ..... 52/685

[58] Field of Search ..... 52/652, 677, 684, 685, 52/686, 719

[56] References Cited

U.S. PATENT DOCUMENTS

| | | |
|---|---|---|
| 860,452 | 7/1907 | Dorner . |
| 1,018,018 | 2/1912 | Straus . |
| 1,121,639 | 12/1914 | Lampert . |
| 1,498,595 | 6/1924 | Wedmore . |
| 1,750,286 | 3/1930 | Sherwan . |
| 1,794,138 | 2/1931 | Bitney . |
| 3,257,767 | 6/1966 | Lassy . |
| 3,471,986 | 10/1969 | Swenson . |
| 3,512,330 | 5/1970 | Shlesinger . |
| 3,722,164 | 3/1973 | Schmidgall . |
| 4,301,638 | 11/1981 | Schmidgall . |
| 4,452,026 | 6/1984 | Tolliver . |
| 4,467,995 | 8/1984 | Tolliver . |
| 4,641,991 | 2/1987 | Yaoita . |

FOREIGN PATENT DOCUMENTS 400421 7/1909 France ..... 52/684

OTHER PUBLICATIONS

Havemeyer Bars and Ty-Units, May, 1914, *Concrete Cement Age,* 52-686.

*Primary Examiner*—David A. Scherbel
*Assistant Examiner*—Jerrold D. Johnson
*Attorney, Agent, or Firm*—Orrin M. Haugen; Thomas J. Nikolai; Frederick W. Niebuhr

[57] ABSTRACT

A spacer is provided for locating a reinforcing cage or fabric, with respect to a form, when manufacturing reinforced concrete articles such as piping, manhole sections, walls and the like. The spacer is formed from a single length of heavy gauge steel wire, and includes a mounting section which wraps around a longitudinal rod of the reinforcing framework and abuts a transverse rod at its junction with the longitudinal rod. An intermediate section of the spacer extends transversely from the mounting section and is approximately parallel to the transverse rod. A hook at the end of the intermediate section remote from the mounting section is positioned to latchingly engage the transverse rod responsive to elastic deformation of the spacer, thereby to securely maintain the spacer on the reinforcement framework. A spacing loop of a predetermined dimension is provided along the intermediate section.

7 Claims, 1 Drawing Sheet

SPACER FOR CONCRETE REINFORCING FABRIC

BACKGROUND OF THE INVENTION

This invention relates to articles constructed of reinforced concrete, and more particularly to locating steel reinforcement fabric or mesh in relation to forms and the like when manufacturing such products.

In the manufacture of pre-cast concrete floors, walls, concrete pipe, manhole sections, and other products, it is well known to employ a steel reinforcement framework such as a flat mesh, woven wire fabric or cylindrical cage. The reinforcement adds tensile strength and otherwise enhances product life and durability. Typical reinforcing frames are constructed of perpendicular rods, bars or wires welded together at their points of intersection. Longitudinal and transverse rods form a flat mesh, and axial and circumferential rods form a reinforcing cage for concrete pipe. The respective intersecting members typically are uniformly spaced apart to provide generally rectangular windows with typical sizes of 2"×4", 4"×8", 2"×12" and numerous intermediate sizes. The rods, bars or wires themselves have diameters ranging from 0.08 to 0.66 inches.

A critical design feature for such products is the thickness of the concrete cover over the framework. In the case of concrete piping or manhole sections, the coverage is determined by the spacing between the reinforcement cage and the outside form or jacket, and in the other direction between the cage and an inside form or core.

To provide a predetermined spacing, self-mounting wire spacers frequently are attached to the reinforcing framework. The spacers have loops or legs of a predetermined length which project outwardly of the reinforcement fabric and abut the jacket or other form to set the proper spacing. One example of such a spacing element is shown in U.S. Pat. No. 3,471,986 (Swenson). The spacer is constructed of flat, relatively thin spring steel and has opposite hooked ends adapted to snap over parallel, spaced apart wires of a reinforcement cage. U.S. Pat. No. 3,722,164 (Schmidgall) shows a spacer with a wrap-around portion for connection to a reinforcement rod, with an opposed portion for hooking around another one of the reinforcement rods, with a spacer leg projected outwardly of the first rod. A steel spacer having a torsion leg is disclosed in U.S. Pat. No. 4,452,026 (Tolliver).

One method of manufacturing concrete piping, known as the packer-head method, requires particularly strong spacer elements. The packer-head method does not employ an inside form or core, but rather utilizes a rotating packer-head to compact low moisture concrete against the outside form or jacket, with the reinforcement cage spaced with reference to the jacket. As it compacts the concrete, the packer-head imparts a substantial rotational force to the cage, and in fact can rotate the cage. The spacer elements must withstand this rotational force, and avoid bending or becoming dislodged from the cage under such force.

The above spacers, however, are too thin for such heavy-duty applications, particularly for larger reinforced pipe and manhole sections which can have diameters as large as 9 feet and utilize packer-heads as large as 78 inches in diameter. The Swenson spacer, due to its flat construction, presents sharp edges to the jacket seam during any rotation of the cages in the jacket when the packer-head method of forming is used, and can become dislodged during compacting. A strengthening of this spacer, for example by increasing its size, would render it difficult to mount without special tools. The Schmidgall spacer likewise would be difficult to mount if increased in size to provide the needed strength. This spacer leg ends in an unfinished edge which can damage the jacket and is subject to bending under the forces induced by the packer-head. The Tolliver spacer needs an intermediate rod, bar or other member for support. The spacer disclosed by Tolliver further must be constructed of a 10 gauge or thinner wire, due to its reliance upon torsional forces, particularly in the torsion leg, for mounting of the spacing element. Such mounting, in the case of heavy gauge spacers, could not be accomplished by hand.

The prior art does include heavy-duty spacing elements. For example, in U.S. Pat. No. 3,440,792 (Schmidgall), a heavy-duty spacer is disclosed for setting the distance between two parallel reinforcement frames, with a spacer loop at one end for determining the distance between one of the frames and a form. U.S. Pat. No. 4,301,638 (Schmidgall) discloses a heavy-duty spacer constructed of 3/16" diameter material, with S-shaped hooks at one end and a bight at the other. Due to the strength of the spacer material, a tool is required for acting upon the bight end to install the spacer. This spacer depends upon a consistent, accurate spacing between the transverse rods of the reinforcement framework, so that different size spacers would have to be maintained in inventory to accommodate the various spacings between reinforcement rods. Also, a deviation in such spacing affects the spacing loops and thus can alter the separation between the frame and jacket.

Therefore it is an object of the present invention to provide a means for accurately, easily and inexpensively positioning steel reinforcing frames with respect to forms to facilitate the manufacture of reinforced concrete articles.

Another object is to provide a spacer element which is heavy-duty in construction but conveniently mounted by hand to a reinforcement mesh or cage.

Another object of the invention is to provide a wire spacing element in which elastic deformation occurs in a plane normal to the extension of spacing loop and therefore has minimal effect on the critical spacing dimension or function of the loop.

Yet another object is to provide a sturdy wire spacing element suitable for installation on a reinforcement mesh or cage, regardless of the spacing between adjacent parallel rods in the framework.

SUMMARY OF THE INVENTION

To achieve these and other objects, there is provided an apparatus suited for removable attachment to a concrete reinforcing framework. The framework includes a plurality of parallel and spaced apart longitudinally directed first frame members and a plurality of parallel, spaced apart and generally transverse second frame members. The first and second frame members are connected to one another at a plurality of junctions where they intersect.

The apparatus includes a unitary spacing member constructed of a flexible material and having a mounting section positionable in surrounding relation about a selected one of the first frame members. A first end portion of the mounting section is positioned against a selected one of the second frame members. The spacing member has an intermediate section at least twice as long as the mounting section. The intermediate section extends from a second and opposite end portion of the mounting section to define a reference plane including the mounting section and the intermediate section. The intermediate section further includes a spacing means directed generally normal to the reference plane with an apex positioned a predetermined distance from the reference plane. A latching means is provided at the end of the intermediate section remote from the mounting section, for forming a latching engagement with the selected second frame member. When the mounting section surrounds the selected first member and is positioned against the selected second frame member, the spacing member is constrained against rotation relative to the framework in a first direction about transverse axes. The mounting section and intermediate section are adapted for elastic bending substantially in the reference plane to move the latching means in the first direction to its latching engagement. The residual force of the elastic bending tends to maintain the latching engagement and secure the spacing member substantially rigidly on the framework.

Preferably the spacing means is a single, generally U-shaped spacing loop located along a portion of the intermediate section near the mounting section. The mounting section can include first and second generally semicircular loops longitudinally spaced apart from one another. When the mounting section surrounds the selected first frame member, the semicircular sections are in a wrapping engagement about the first frame member on opposite sides of it.

The preferred latching means includes a leg extended generally longitudinally from the intermediate section, and a hook at the end of the leg remote from the intermediate section. The spacer member preferably is unitary, and constructed of a heavy gauge wire, for example 6 gauge (0.192 inches in diameter).

A spacing element in accordance with the present invention is conveniently installed on a wire cage or other reinforcement simply by wrapping the mounting section about one of the reinforcement rods, abutting that section against a selected perpendicular rod, then bending the intermediate section to enable the hooking section to engage the same perpendicular rod. There is no need for an intermediate rod to support the intermediate leg, nor must the rods in either direction be spaced apart a predetermined distance. As a result, the reinforcement cage or mesh can be constructed without unduly accurate spacing between adjacent parallel rods, and an inventory of a single size spacer can suit a wide variety of cage or mesh sizes.

The bending of the mounting section and intermediate section necessary for installation, and for the residual elastic forces maintaining the spacer/reinforcement frame coupling, occurs in the reinforcement plane, which is perpendicular to the extension of the spacer loop. Thus, the amount of bending has no influence upon and does not materially distort the critical dimension of the spacing loop. Moreover, in spite of its convenient hand installation, the spacing element has sufficient strength to maintain its configuration and its grip upon the reinforcement cage, even under the extreme torque generated by a packer-head.

BRIEF DESCRIPTION OF THE DRAWINGS

For a better understanding of the above and other features and advantages, reference is made to the following detailed description and the drawings, in which.

DETAILED DESCRIPTION OF THE PREFERRED EMBODIMENT

Figure 1:
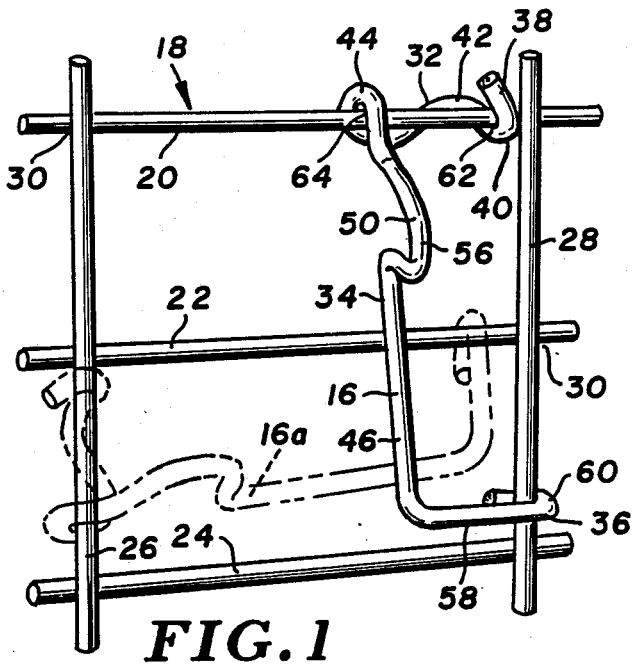
FIG. 1 is a perspective view of a spacing element constructed in accordance with the present invention and installed upon a conventional reinforcement cage.

Turning now to the drawings, there is shown in FIG. 1 a spacing element 16 constructed in accordance with the present invention and installed upon a steel reinforcement cage 18 of the type conventionally used in the manufacture of concrete reinforced piping. The reinforcement cage is constructed of mutually perpendicular and spaced apart rods or wires, including longitudinal or circumferential rods 20, 22 and 24, and transverse rods 26 and 28 which run axially of the reinforcement cage. The longitudinal and transverse rods are connected at their junctions as indicated at 30, typically by welding. Furthermore, the circumferential rods are connected at their opposite ends to form rings of the desired configuration, typically circular or elliptical. The end joinder is not shown, but is a well known feature of a reinforcement cage.

It should be understood that spacing element 16 can readily be installed upon substantially flat reinforcement as well, such as reinforcement fabric or mesh. Spacing element 16 preferably is formed preferably is formed of a single strand of wire, preferably 6 gauge or heavier, of a 1008–1010 low carbon cold drawn steel. So constructed, the spacing element is sufficiently strong to withstand forces inherent in the piping manufacturing process, particularly in connection with processes employing packer-heads, yet is conveniently hand installed.

The spacing element is formed into discrete sections, including a mounting section 32, an intermediate section 34 extended generally normal to the mounting section, and a latching section 36 generally parallel to the mounting section. When the spacing element is properly installed, mounting section 32 is disposed longitudinally, in wrapping engagement or nesting about one of the rods, e.g. rod 20.

Mounting section 32 includes an outer end portion 38 which incorporates a substantially semicircular outer segment or loop 40. A generally S-shaped segment 42 joins loop 40 to an inner segment or loop 44 which also is substantially semicircular. S-shaped segment 42 supports loops 40 and 44 in approximately 180° opposition to one another, so that these loops together completely surround rod 20 as perhaps best seen in FIG. 2.

Intermediate section 34 extends from the inner end portion of mounting section 32, and is generally normal to the mounting section. Accordingly the mounting section and the intermediate section, particularly along a linear portion 46 thereof, defines a reference plane which appears in FIG. 2 as a straight line 48 representing an edge of the plane. Formed in the intermediate section near mounting section 32 is a spacing loop 50 extended away from and generally normal to reference plane 48. More particularly, spacing loop 50 includes legs 52 and 54 converging at an apex 56 spaced at a predetermined distance from the reference plane, typically in the range of from one-half to two inches. The distance between the apex and reference plane is selected in accordance with the desired spacing between reinforcement cage 18 and an outer form or jacket (not shown) when the reinforced piping is manufactured. Loop 50 can have any desired shape, so long as the apex is correctly located. Also, loop 50 can be positioned anywhere along intermediate section 34, and more than one loop may be provided.

Latching section 36 includes a substantially linear latching leg 58 extended substantially parallel to the mounting section and from the lower end of intermediate section 34. At the end of latching leg 58 remote from the intermediate section is a C-shaped hook 60 shown in wrapping engagement about transverse rod 28, but adapted to wrappingly engage any longitudinal or transverse rod.

Figure 3:
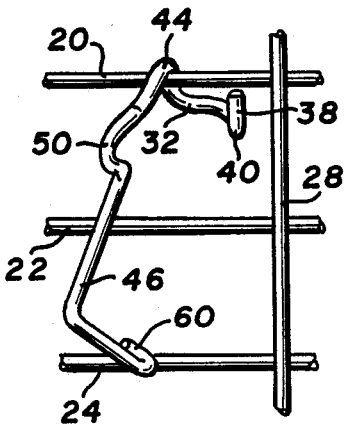
FIGS. 3–5 illustrate the sequence of installing the spacing element onto the cage.
Figure 4:
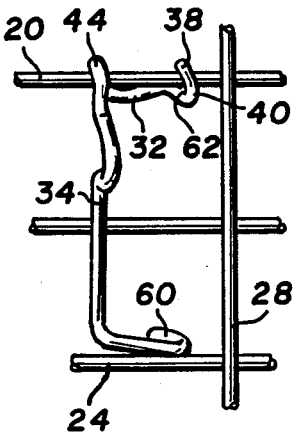
Figure 5:
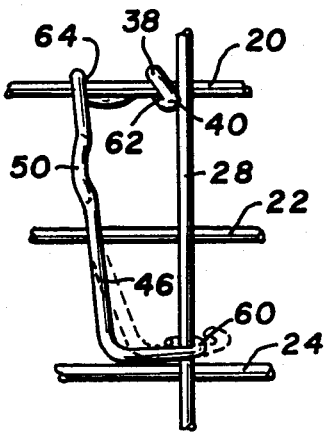

As illustrated in FIGS. 3–5, spacing element 16 is quickly and conveniently installed by hand. The spacing element first is fastened by hanging onto longitudinal rod 20, utilizing inner loop 44 disposed above rod 20. Intermediate section 34 is positioned to slant downwardly and to the left as viewed in the figures, to position outer end portion 38 of mounting section 32 below rod 20.

Next, the spacing element is rotated counterclockwise to the position shown in FIG. 4, causing outer loop 40 to engage longitudinal rod 20 at a contact point or area 62, with inner loop 44 nested against the same rod at a contact point or area 64. This engagement of mounting section 32 with longitudinal rod 20 prevents further counterclockwise rotation of spacing element 16, at least in the absence of elastic deformation of the spacing element. Any efforts to rotate the spacer counterclockwise simply moves it rightward as viewed in FIG. 4 until end portion 38 abuts transverse rod 28.

At this point, the spacing element must be elastically deformed, a sufficient amount to move intermediate section 34 counterclockwise in an arc about an axis normal to the reference plane, a sufficient amount to move hook 60 to the right of transverse rod 28 as shown in FIG. 5. To complete the installation, the intermediate section is allowed to travel slightly clockwise until the hook engages the rod as illustrated in FIG. 1. In the installed condition as shown in FIGS. 1 and 2, spacing element 16 remains elastically deformed.

Figure 2:
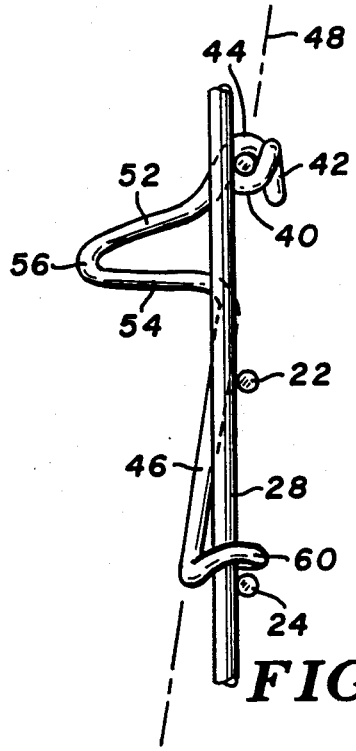
FIG. 2 is an end elevation of the spacing element and reinforcement cage.
Figure 6:
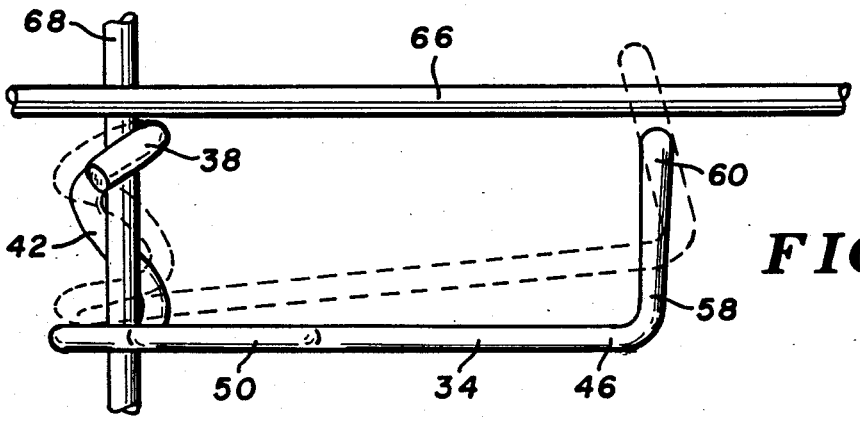
FIG. 6 illustrates the nature of the elastic deformation of the spacing element which facilitates its installation.

Once installed as shown in FIGS. 1 and 2, spacing element 16 is maintained substantially rigidly on reinforcement cage 18 due to its elastic memory or residual stress. FIG. 6 illustrates the nature of the elastic deformation, in exaggerated form, with the spacer installed horizontally on a mesh including a longitudinal rod 66 and a transverse rod 68. Essentially, the elastic deformation is a combination involving the bending of intermediate section 34 in the nature of a beam and about an axis normal to the reference plane, along with compression of mounting section 32. An advantage of the present invention resides in the fact that these forces are directed substantially parallel to the reference plane, with negligible force components normal to the plane. Accordingly, the forces do not distort the distance between apex 56 and the reference plane, thus to preserve the integrity of the spacing loop in spite of any variance in the residual elastic forces in the spacing element.

Given the heavy-duty requirements for spacing element 16 and its corresponding size, i.e. 6 gauge or heavier wire, a relatively small amount of elastic deformation generates sufficient residual elastic force to positively secure the spacer to the reinforcement cage. In fact, it has been found that hook 60 can be configured to engage transverse leg 28 (FIG. 1) or longitudinal rod 66 (FIG. 6) when moved as little as one-fourth of an inch in the counterclockwise direction or upwardly as viewed in FIG. 6, from a normal, unstressed configuration in which there is no elastic deformation of the spacing element.

Nonetheless, substantially greater elastic deformation, for example an amount necessary to position hook 60 and latching leg 58 0.25" upwardly from the normal configuration, is required in order for hook 60 to clear rod 66. Accordingly, intermediate section 34 should be at least twice as long as the mounting section in order to provide the desired leverage for convenient hand installation. In one form of the present embodiment spacing element, mounting section 32 is about $1\frac{1}{4}$ to $1\frac{1}{2}$ inches long, while the length of intermediate section 34 is approximately 4 to $4\frac{1}{2}$ inches.

In FIG. 6, only longitudinal rod 66 and transverse rod 68 are illustrated, to point out a feature of the invention. Namely, all that spacing element 16 requires for mounting is two intersecting members of the reinforcement framework. There is no need for parallel members spaced apart a predetermined distance from one another, nor is there any need for an intermediate member or rod to support intermediate section 34. Consequently, spacing element 16 is adaptable to a multiplicity of sizes for reinforcement cages and fabric. Typically the minimum spacing between adjacent parallel members of the framework is 2 inches. Consequently mounting section 32 can be positioned in wrapping engagement about, and at virtually any location along, any rod of the reinforcement. Thus, spacing elements constructed in accordance with the present invention eliminate the need to provide custom sized spacers for various reinforcement framework sizes.

Another advantage illustrated in FIG. 6 is that spacing element 16 can be mounted with intermediate section 34 generally horizontally disposed, as well as vertically (FIG. 1). It is well within the scope of the present invention to mount the spacing element to a reinforcement mesh with obliquely inclined members as well, so long as two such members and their intersection or junction can be utilized.

Returning to FIG. 1, a spacing element **16*a* is represented in broken lines in a horizontal disposition. In contrast to FIG. 6, FIG. 1 illustrates the transverse rods in front of, rather than behind, the longitudinal rods. This third installment configuration is possible whenever the spacing between adjacent "front" members, i.e. rods 26 and 28 in FIG. 1, exceeds the length of the spacing element. Since the elastic deformation forces maintaining the spacing element act largely within the reference plane, no intermediate transverse member is required to provide support along the intermediate section. In the case of spacing element 16 as shown in FIG. 1, intermediate transverse rod 22**, as previously mentioned, need not and in fact does not contact the spacing element. Such intermediate transverse members, when behind the longitudinal members, not only are not required, but do not interfere with the mounting of the spacer as shown. Consequently the spacing elements can be mounted in virtually any desired or convenient orientation.

Thus, the spacing element is conveniently installed without any special tool, yet is secured firmly upon the reinforcement cage. The length of the intermediate section provides a lever arm for the required placement of hook 60, for maintaining compression of mounting section 32. In particular, the mounting section is compressed an amount greater than would be possible through direct hand action along, for example, longitudinal rod 20 in FIG. 1. This compression, and the wrapping engagement of semicircular loops 40 and 44 about the rod, positively secure spacing element 16 against the tendency of a packer-head to dislodge it from the cage, or to move it circumferentially or sideways along the cage. Given the heavy gauge steel employed in the spacing element, it resists bending as well. Thus is disclosed a free-standing yet tightly mounted heavy-duty and universal spacer, suitable for vertical or horizontal installation on reinforcement fabric or cages.

What is claimed is:

1. An apparatus suited for removable attachment to a concrete reinforcing framework, said framework including a plurality of parallel and spaced apart longitudinally directed first frame members and a plurality of parallel, spaced apart and generally transverse second frame members, said frame members connected to one another at a plurality of junctions, said apparatus including:

a unitary spacing member constructed of a flexible material and having a mounting section positionable in wrapping engagement about a selected one of said first frame members, with a first end portion of said mounting section positioned against a selected one of said second frame members;

an intermediate section at least twice as long as said mounting section, said intermediate section extended generally orthogonally from a second end portion of said mounting section to define a reference plane including said mounting section and said intermediate section, said intermediate section including a spacing means directed generally normal to said reference plane with an apex positioned a predetermined distance from the reference plane; and a latching means, at the end of said intermediate section remote from said mounting section, for forming a latching engagement with said selected second frame member;

wherein said spacing member is constrained, due to said wrapping engagement, against rotation relative to the framework in a first direction about axes normal to said reference plane, and wherein said latching means is located proximate said selected second frame member whenever said mounting section is so positioned against said selected second frame member, whereby movement of said latching means in said first direction, toward said selected second frame member and into said latching engagement, causes an elastic bending of said intermediate section substantially in said reference plane and further causes an elastic compression of said mounting section, and wherein the residual forces of said elastic bending and said elastic compression are parallel to said reference plane and tend to maintain said latching engagement to thereby secure said spacing member on said framework.

2. The apparatus of claim 1 wherein:

said spacing means comprises a single, generally U-shaped spacing loop.

3. The apparatus of claim 2 wherein:

said spacing loop is located along a portion of said intermediate section proximate said mounting section.

4. The apparatus of claim 1 wherein:

said latching means includes a generally C-shaped hook.

5. The apparatus of claim 4 wherein:

said latching means further includes a leg extended generally longitudinally from said intermediate section and between the intermediate section and said hook.

6. The apparatus of claim 1 wherein:

said elastic material comprises a 6 gauge or heavier wire formed of a cold drawn steel.

7. An apparatus suited for removable attachment to a concrete reinforcing framework, said framework including a plurality of parallel and spaced apart longitudinally directed first frame members and a plurality of parallel, spaced apart and generally transverse second frame members, said frame members connected to one another at a plurality of junctions, said apparatus including:

a unitary spacing member constructed of a flexible material and having a mounting section including first and second semicircular segments longitudinally spaced apart from one another, said mounting section further including an S-shaped segment between said semicircular segments, said first and second semicircular segments being disposed in opposition to one another and positionable in wrapping engagement about opposite sides of a selected one of said first frame members, with said first semicircular segment positioned against a selected one of said second frame members;

an intermediate section at least twice as long as said mounting section, said intermediate section extended generally orthogonally from an end portion of said mounting section including said second semicircular segment to define a reference plane including said mounting section and said intermediate section, said intermediate section including a spacing means directed generally normal to said reference plane with an apex positioned a predetermined distance from the reference plane; and a latching means, at the end of said intermediate section remote from said mounting section, for forming a latching engagement with said selected second frame member;

wherein said spacing member is constrained, due to said wrapping engagement, against rotation relative to the framework in a first direction about axes normal to said reference plane, and wherein said latching means is located proximate said selected second frame member whenever said mounting section is so positioned against said selected second frame member, whereby movement of said latching means in said first direction, toward said selected second frame member and into said latching engagement, causes an elastic bending of said intermediate section substantially in said reference plane, and wherein the residual forces of said elastic bending are parallel to said reference plane and tend to maintain said latching engagement to thereby secure said spacing member on said framework.

* * * * *